United States Patent [19]

Terakado et al.

[11] 4,395,021

[45] Jul. 26, 1983

[54] VERTICAL CONTINUOUS ANNEALING FURNACE AND ITS OPERATING METHOD

[75] Inventors: Ryoji Terakado; Masaru Iwasa; Ituo Takahashi; Norio Anzawa; Gen Yoshida, all of Muroran, Japan

[73] Assignee: Nippon Steel Corporation, Tokyo, Japan

[21] Appl. No.: 347,235

[22] Filed: Feb. 8, 1982

[51] Int. Cl.[3] ..... C21D 9/56

[52] U.S. Cl. ..... 266/85; 266/87; 266/90; 266/113; 266/103; 34/242; 432/250

[58] Field of Search ..... 432/8, 59, 250, 242; 266/102, 103, 110, 81, 85, 87, 90, 113; 34/242

[56] References Cited

U.S. PATENT DOCUMENTS 3,110,484 11/1963 Anderson et al. ..... 34/242
4,165,964 8/1979 Yonezawa et al. ..... 432/59

FOREIGN PATENT DOCUMENTS 53-135808 of 1978 Japan .
55-21818 of 1980 Japan .

*Primary Examiner*—L. Dewayne Rutledge
*Assistant Examiner*—Christopher W. Brody
*Attorney, Agent, or Firm*—Wenderoth, Lind & Ponack

[57] ABSTRACT

A vertical continuous annealing furnace has two furnace covers vertically spaced away from each other. Each furnace cover is laterally slidable with respect to the furnace proper and has two long narrow openings through which strip is passed. There is a relatively small pre-chamber between the first furnace cover above and the second furnace cover below. The space below the second furnace cover constitutes a heating chamber. A partition extends from the undersurface of the second furnace cover to near the bottom of the furnace, dividing the heating chamber into a heating zone and a soaking zone. In charging and discharging the strip, the two furnace covers are alternately opened and closed, thereby keeping the heating chamber out of exposure to the outside air.

15 Claims, 19 Drawing Figures

VERTICAL CONTINUOUS ANNEALING FURNACE AND ITS OPERATING METHOD

BACKGROUND OF THE INVENTION

This invention relates a vertical continuous annealing furnace, and a method of operation thereof, particularly suited for annealing strip of such special steels as stainless steel.

The conventional tower-type continuous annealing furnace calls for hearth rollers to guide the vertical path of strip running up and down. These hearth rollers are able to withstand temperature of 650° C. to 720° C. with which plain carbon steel strip is treated. In a higher temperature range between 800° C. and 1,000° C. in which stainless steel strip is annealed, however, there arises a problem of scale buildup on the surface of the hearth rolls which might, in turn, produce surface defects on the strip threaded thereover. For this reason, stainless steel strip has been treated in horizontal tunnel-type furnaces, ranging between 10 and 18 meters in length.

In an attempt to offer a solution to this problem, one of the inventors proposed a vertical continuous annealing furnace suited for the annealing of stainless and other similar steel strip in Japanese Patent Application No. 50900 of 1977 (Japanese Patent Public Disclosure No. 135,808 of 1978). This prior invention is characterized by providing a slit-like opening in the furnace-top cover, through which strip is continuously fed into the furnace to form a catenary-like freely hanging loop to which annealing heat is applied. This furnace has no strip-guiding hearth rollers at all. In other words, a vertical furnace dispensing with hearth rollers was the main point of this prior invention.

However, this prior invention was not without problems. When the line stops, strip is held within the furnace in the freely looped state mentioned before, where it is oxidized by an oxidizing atmosphere resulting from the rapid heating of strip and, thereby, giving rise to steel loss and a reduction in its quality. To avoid this, the freely looped strip, while the line is at a standstill, should preferably be lifted and horizontally hung over the charging and discharging pinch rolls. Yet, this cannot be achieved without opening the furnace-top cover, which would expose the interior of the furnace to the outside air. This exposure would cause a heavy heat loss and, in serious cases, the spalling of furnace walls as a result of rapid cooling from a higher temperature level.

The same prior invention gave no particular specification as to the arrangement of heating burners. The description of its preferred embodiments states simply that heating burners are disposed inside the furnace. The attached drawings show the burners disposed in a single vertical row on each side of a vertical partition wall hanging down from the furnace top. Later experiments, however, have shown that this burner arrangement is not satisfactory.

With the vertical partition wall mentioned above integral with the furnace top cover, the furnace according to the prior invention is divided into two sections, the entry and delivery sides, which are thermally cut off from each other.

However, when the furnace is used for soaking heated strip, both the furnace and strip temperatures are in many cases substantially the same on either side of the partition wall. In such cases, there is no need to eliminate the mutual thermal effect of strip between the entry and delivery sides. Rather, the heat buildup by the partition wall leads to a heat loss and a damaging of the furnace's unit heat consumption.

Having enough space inside and, therefore, receiving no pressure from the piece charged therein, vertical continuous annealing furnaces need no strength to withstand any such pressure. Also, their walls should cause as little heat buildup as possible so that their heating pattern may be switched quickly as the type of steel treated changes. For these reasons, it was thought preferable that the furnace wall refractories possess both high thermal resistance and good heat-insulating properties, so ceramic fiber came into popular use. Later again, it was found that the strip traveling through the furnace often hits and damages the furnace walls of ceramic fiber while weaving in a loop or upon falling as a result of breaking.

In the vertical annealing furnaces that have no strip-guiding hearth rollers in the bottom, strip is allowed to turn upward freely drawing a loop, making it necessary to keep the lower end of the free loop at a substantially steady level.

It is also necessary to give special consideration to the emission of combustion gas so that as much uniform heating as possible may be achieved through a further enhancement of the furnace's thermal efficiency.

Where stainless or other special steel is involved, special considerations must be given also to cooling means, since attaining the aimed-for metallurgical structure in such steel calls for more delicate and subtle adjustments than in the case of plain carbon steel.

Where a great treating capacity is required, two or more furnaces must be installed in series since the capacity of one furnace is limited. Such a series arrangement facilitates accelerating the strip treating speed, increasing the production capacity, and applying various heating patterns. Meanwhile it is essential to prevent the escape of heat from the strip traveling from one furnace to another to avoid the waste of energy and minimize the effect of heat loss on steel quality.

SUMMARY OF THE INVENTION

This invention has been made to solve the aforementioned problems with the conventional vertical continuous annealing furnaces.

An object of this invention is to provide a vertical continuous annealing furnace that does not permit any excessive emission of heat or development of spalling on the furnace walls even when the furnace is opened when the strip manufacturing line stops.

Another object of this invention is to provide a vertical continuous annealing furnace that is capable of uniformly heating strip with high thermal efficiency.

Still another object of this invention is to provide a vertical continuous annealing furnace whose walls have high thermal resistance and good heat-insulating properties, and are protected against the damage that might be caused by strip.

Yet another object of this invention is to provide a vertical continuous annealing furnace that is capable of cooling heated strip exactly to the aimed-for temperature.

A further object of this invention is to provide a vertical continuous annealing furnace that is used in plurality to offer a high production capacity and a variety of heating patterns.

A still further object of this invention is to provide a vertical continuous annealing furnace that permits quick charging and discharging of strip without emiting any excessive amount of heat or developing spalling on the furnace walls.

A vertical continuous annealing furnace according to this invention has two furnace covers at its top, vertically spaced away from each other. Each cover is laterally slidable with respect to the furnace proper, and provided with two slots through which strip is passed. There is a relatively small pre-chamber between a first cover above and a second cover below. The space below the second cover constitutes a heating chamber. Below the second cover is provided a partition wall that extends to near the furnace bottom to divide the heating chamber into a heating zone and a soaking zone. The heating chamber has a plurality of burners and combustion gas exhaust ports.

Strip is inserted from an opening in the furnace top in such a manner as to surround the partition wall, or in a catenary-like form. In feeding strip into the hot-heated furnace, it is first inserted into the pre-chamber to form a small loop therein, with the upper first cover opened and the lower second cover closed. Then, the first cover is closed and the second cover opened to allow the loop of strip to descend to near the furnace bottom. When the loop of strip has been lowered into position, the second cover is closed.

To take out the heated strip out of the turned-off furnace, the above procedure is reversed.

With the vertical continuous annealing furnace of this invention, as evident from the above, strip can be charged and discharged without exposing the heating chamber to the outside air. This prevents the escape into the atmosphere of the heat retained by the walls of the heating chamber and their damage by spalling.

Other objects, features and advantages of this invention will become apparent from the following detailed description which is to be read by reference to the accompanying drawings.

DETAILED DESCRIPTION OF THE PREFERRED EMBODIMENTS

Structure of the Furnace

Figure 1:
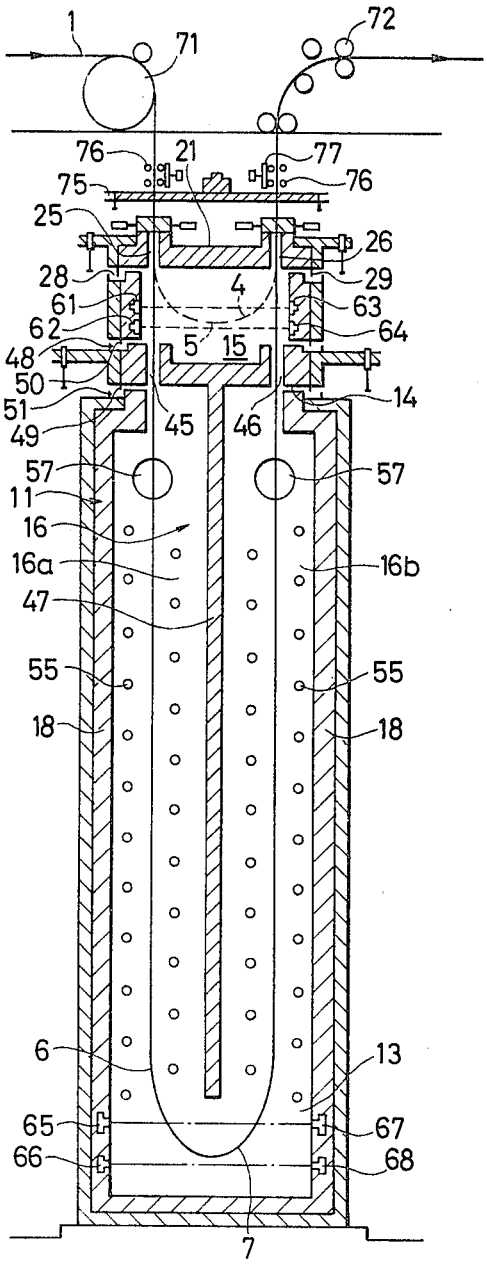
FIG. 1 is a cross-sectional view showing a vertical continuous annealing furnace embodying the principle of this invention.
Figure 2:
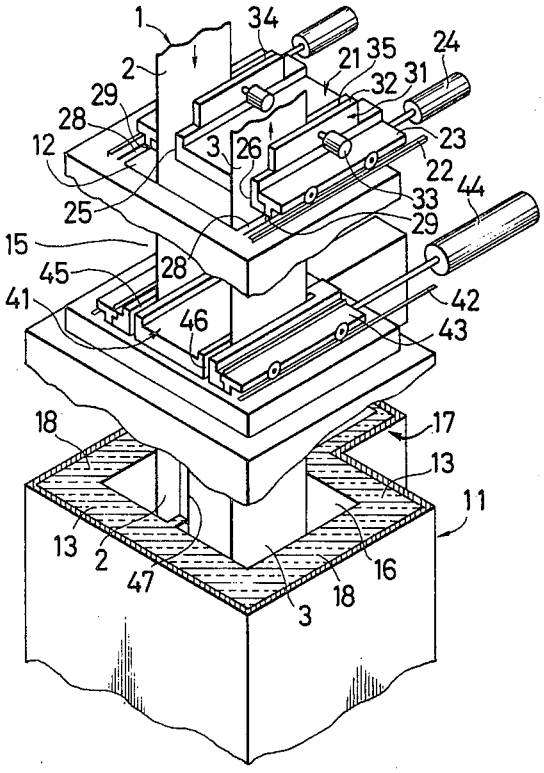
FIG. 2 is a perspective view showing the top section of the furnace proper illustrated in FIG. 1.

As shown in FIGS. 1 and 2, the furnace proper 11, rectangular in horizontal cross section, has a furnace mouth 12 in its top that opens upward. Through this furnace mouth 12, strip 1 is inserted from above into the furnace in a catenary-like form.

On top of the furnace proper 11 is placed a first furnace cover 21, which is laterally slidable in the direction of the width of the strip 1 inserted in the furnace, in such a manner as to close the furnace mouth 12. More specifically, a pair of laterally extending rails 22 are laid, spaced longitudinally (or in the direction perpendicular to both sides), near the top of the furnace proper 11. The furnace cover 21 is fastened to the side of a bogie 23 mounted on the rail 22. The bogie 23 is laterally driven by a hydraulic cylinder 24 connected to one end thereof.

The first furnace cover 21 is provided with a pair of long narrow openings 25 and 26 which, being spaced away from each other in the longitudinal direction of the furnace, extend laterally from the side opposite to the one on which the hydraulic cylinder 24 is situated. These long narrow openings 25 and 26 are slightly longer than the width of the strip 1 and sufficiently wider than its thickness. The space between the two openings 25 and 26 is equal to the space between the descending portion 2 and the ascending portion 3 of the strip 1.

A pair of laterally extending water-seal grooves 28 are provided along the edges of the furnace mouth 12 at the top of the furnace proper 11. A pair of seal edges 29, which project toward and extend along the water-seal grooves 28, are provided on the undersurface of the first furnace cover 21. With the seal edge 29 put in the water-seal groove 28 filled with water, a seal is kept between the furnace proper 11 and the first furnace cover 21. This seal is by no means limited to a water seal; a sand seal can serve the purpose, as well.

An open-close sealing device 31 is provided on the top surface of the first furnace cover 21, adjacent to each of the long narrow openings 25 and 26. This open-close sealing device 31 comprises a sealing mechanism 32 that closes the openings 25 and 26 and a pneumatic cylinder 33 that moves back and forth the sealing mechanism 32 perpendicular to the surface of the strip 1. The sealing mechanism 32 comprises a pair of sealing surfaces of ceramic fiber, which hold the strip 1 therebetween, and air seal. By this means, the sealing mechanism 32 forms a slit-like charging port 34 and discharging port 35 which close the long narrow openings 25 and 26, respectively.

A lateral opening 14 is provided in the wall 13 of the furnace proper 11 on the side on which the hydraulic cylinder 24 is installed. In this opening 14 is inserted a laterally slidable second furnace cover 41. The space between the second furnace cover 41 and the first furnace cover 21 constitutes a pre-chamber 15 of the furnace. Like the first furnace cover 21, the second furnace cover 41 also is fastened to a bogie 43 running over rails 42. A hydraulic drive cylinder 44 is connected to the bogie 43. The second furnace cover 41 also has long narrow openings 45 and 46. The second furnace cover 41 separates the pre-chamber 15 from the lower portion of the furnace proper 11 which constitutes a heating chamber 16.

Figure 3:
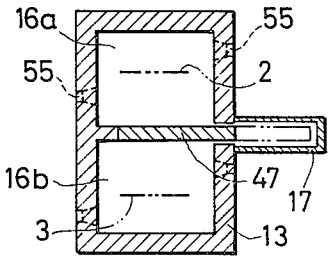
FIG. 3 is a horizontal cross section of the furnace proper illustrated in FIG. 1.
Figure 4:
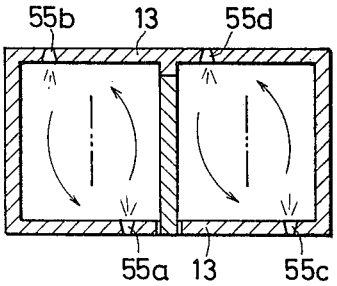
FIG. 4 is a horizontal cross section of the furnace proper to illustrate the location of burners.

On the undersurface of the second furnace cover 41, midway between the long narrow openings 45 and 46, there is provided a vertical partition 47 that extends to near the bottom of the furnace, so that the second furnace cover 41 is T-shaped in vertical cross section. The partition 47 divides the heating furnace into the front and rear sections, as shown in FIG. 3. One of the side walls 13 of the furnace proper 11 is formed into a laterally projecting receding chamber 17 that accommodates the receding partition 47.

Each of the upper and lower surfaces of the second furnace cover 41 has a water-seal groove 48 and a seal edge 49. A matching seal edge 50 and water-seal groove 51 are provided in such positions of the furnace proper 11 that correspond to the water-seal groove 48 and seal edge 49, respectively.

A number of burners 55 are provided on the side walls of the heating chamber 16. The burners 55 are arranged in two vertical lines, one line on each side of the strip 1, with the burner 55 in one line horizontally staggered with respect to those in the other line, on the side walls in each of the heating zone 16*a* and soaking zone 16*b* divided by the partition 47. In a set of burners 55 provided at substantially the same level on the side walls 13, the burners 55*a* and 55*b*, and the burners 55*c* and 55*d*, are diagonally symmetrical to each other, with the strip 1 standing midway therebetween, with each of the paired burners being positioned at substantially the same distance from the front and rear surface of the strip 1. The vertical distance between the individual burners 55 is determined according to the heating speed and soaking temperature of the strip 1.

With the heating burners 55 arranged as described above, flames circulatingly flow about the strip 1, like a whirlwind spinning around in a sheath-like squashed cylindrical form. The burners 55 may also be arranged in such a manner that the direction of the whirlwind is reversed in the heating and soaking zones.

Figure 5:
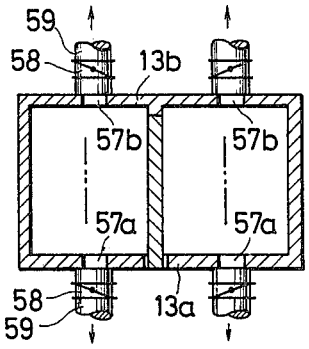
FIG. 5 is a horizontal cross section of the furnace proper to illustrate the location of combustion gas exhaust ports.

In each of the heating zone 16*a* and soaking zone 16*b*, combustion gas exhaust ports 57 are provided above the heating burners 55 or close to the top of the side walls 13, as shown in FIG. 1. A combustion gas exhaust port 57*a* provided in the side walls 13*a* is opposite to another exhaust port 57*b* in the side wall 13*b*, as shown in FIG. 5. These exhaust ports lead to the subsequent unit (such as a heat exchanger) through a piping 59 containing a damper 58.

In the pre-chamber 15 of the furnace proper 11, as shown in FIG. 1, vertically spaced light emitters 61 and 62 are provided on one of the front and rear walls 18, and light receivers 63 and 64 on the opposite wall 18. Similarly, vertically spaced light emitters 65 and 66 are provided on one of the front and rear walls 18 close to the bottom of the heating chamber 16, and light receivers 67 and 68 on the opposite wall 18.

Deflector pinch rolls 71 and 72 are provided where the charging and discharging ports open, respectively, in the top of the furnace proper. A laterally movable upper bogie 75 is disposed between these deflector pinch rolls 71 and 72 and the first furnace cover 21. Paired guide rollers 76 and 77 are mounted on the charging and discharging sides of the upper bogie 75. The strip 1 is held and guided between the paired guide rollers 76 and 77 whose openings are adjustable. The guide rollers 76 may be fixed to a stand because they need not move with the bogie. The main object of the guide rollers 76 and 77 is to center the strip 1 so that it passes, without a hitch, through the slits 25 and 26 in the furnace cover 21. Their openings may be greater than the strip thickness to leave a clearance between the strip and rollers since they do not have to be in constant contact with the strip during operation.

Operation of the Furnace

First, the method of charging strip in the furnace will be described by reference to FIG. 1. At the beginning, the furnace proper 1 is closed with the first furnace cover 21 and the second furnace cover 41. The strip 1 is fed from the left in FIG. 1 and hung over the charging and discharging side deflector pinch rolls 71 and 72. With its leading end pinched by the discharging side deflector pinch rolls 72, the strip 1 is allowed to hang down to form a free loop. As the lower end of the free loop approaches the guide rollers 76 and 77, the inner guide rollers 77 are moved inward. Then the upper bogie 75 is operated to bring the guide rollers 76 and 77 out of the path along which the strip runs. The first furnace cover 21 also is moved outside the path line. With the second furnace cover 41 in a closing position, however, the high-temperature atmosphere in the heating chamber 16 is not exposed to the outside air.

The free loop 4 of the strip 1 is further descended into the pre-chamber 15 until the lower end 5 of the loop reaches a point below the upper detector 63 and above the lower detector 64 in the lower part of the pre-chamber 15. When the free loop 4 reaches the position illustrated in FIG. 1, the upper detector 63 no longer receives light whereas the lower detector 64 is still on, thereby telling the exact position of the lower end 5 of the free loop 4.

With the guide rollers 76 and 77 in their opened position, the upper bogie 75 is returned on to the strip path line. Then, the guide rollers 76 and 77 are set to the pre-determined clearance to center the strip 1 so as to insure its smooth admission in the charging and discharging slits 35 and 36. Then, the bogie 23 carrying the first furnace cover 21 is moved back on to the strip path line to close the top opening of the pre-chamber 15. The sealing mechanism 32, which remained open while the bogie 23 is out of place, seals the atmosphere inside the pre-chamber 15 when the bogie 23 has returned to its in-line position. The space between the furnace proper 11 and the first furnace cover 21 is kept airtight by means of the water-seal groove 28 and seal edge 29.

In this state, the second furnace cover 41 is slid out of the strip path line to open the top of the heating chamber 16. After the strip 1 has been lowered to form the loop 6 illustrated in FIG. 1, the second furnace cover 41 is returned to its original position. By this means, the strip 1 can be fed into the heating chamber 16 to form the free loop 6 without causing any heat loss and spalling of the furnace walls in the heating chamber 16.

As done when charging the strip 1 in the pre-chamber 15, the lower end 7 of the free loop 6 is ascertained by means of the light emitters 65 and 66 and light receivers 67 and 68.

The following describes how the strip thus charged is continuously annealed.

Carried horizontally from the left in FIG. 1, the strip 1 is perpendicularly turned by the charging side deflector pinch rolls 71, and fed into the furnace below at an appropriate speed. The charging side guide rollers 76 hold and guide the strip 1 to descend through the slit-like charging port 35 that is kept airtight by means of the open-close ceramic fiber and air seal. The strip 1 goes down through the long narrow opening 25 in the first furnace cover 21 into the airtight pre-chamber 15, then further down into the heating chamber 16 through the long narrow opening 45 in the second furnace cover 41 that constitutes the ceiling of the heating chamber 16. Then, the strip 1 turns upward in such a manner as to skirt round the partition 47 hanging down, like the letter T, from the undersurface of the second furnace cover 41, to divide the heating chamber 16, describing the free loop 6. After being quickly and appropriately heated and annealed by the heat applied from the burners 55 and discharged through the exhaust ports 57, the strip 1 re-enters the pre-chamber 15 through the long narrow opening 46 in the second furnace cover 41, going futher up to above the furnace through the long narrow opening 26 in the first furnace cover 21 and the slit-like discharging port 36. The discharging side guide rollers 76 hold and guide the strip 1 to the outside of the furnace. The discharging side deflector pinch rolls 72 turn the up-coming strip 1 to run horizontally, and deliver it to the right in FIG. 1 at an appropriate speed.

With the heating chamber having no hearth rollers, as evident from the above, it is unnecessary to set the upper limit of the furnace temperature, which might otherwise be needed to prevent the deterioration of the hearth rollers. This permits annealing stainless steel strip at such a high temperature as over 950° C. Since the strip being heated is not cooled by the contact with the hearth rollers, in addition, the temperature of the strip 1 rises quickly and uniformly through its entirety. Freedom from the hearth rollers-induced heat loss and surface defects, caused by the scale built up on the surface of the hearth rollers, is a great advantage.

The position of the lower end 7 of the free loop being continuously annealed also is controlled by the signals from the light emitters 65 and 66 and light receivers 67 and 68.

The level of the lower end 7 of the strip loop is controlled so that the light emitted from the light emitter 65, being intercepted by the strip loop 6, is always not received by the light receiver 67. This means that the lower end 7 of the strip loop 6 always rests between the light emitter 65 and light receiver 67. In other words, the lower end 7 of the strip loop 6 stays below the light emitter 65 and light receiver 67.

Then, the level of the lower end 7 of the strip loop is controlled so that the light emitted from the light emitter 66 is always received by the light receiver 68. This means that there exists no intercepting object in the path of light at this level. In other words, the lower end 7 of the strip loop 6 stays above the light emitter 66 and light receiver 68.

According to the signals emitted by these detecting means, the amount of strip fed by the charging side deflector pinch rolls 71 or taken up by the discharing side deflector pinch rolls 72 is adjusted to maintain the lower end 7 of the free strip loop at a substantially steady level, thereby permitting a substantially constant length of strip to be held invariably in the heating chamber.

By adjusting the space between these two sets of detecting means, the lower end of the strip loop can be controlled with a desired precision.

If one or more sets of detectors are interposed between these two sets, the lower end of the strip loop can be controlled with a still greater accuracy.

Heated to such a high temperature as 800° C. to 1,000° C., the strip 1 partially loses its rigidity and grows soft in the heating chamber 16, thus drawing a free loop 6 similar to a substantially perfect catenary curve, under the influence of gravity. If the heating burners were disposed vertically and parallel to the walls of the heating chamber, some of the burners would fail to bring flames close enough to the looped strip 1 to give adequate heating, whereas other burners would damage the strip 1 with directly impinging flames.

According to this invention, meanwhile, the strip 1 is uniformly heated by the flames that swing around the strip like a whirlwind circulating in a sheath-like squashed cylindrical form.

As stated previously, a number of heating burners 55 are provided on both sides of the strip loop 6 in the heating zone **16*a* and soaking zone 16*b* of the heating chamber 16. After circulating through the furnace, flames are discharged through a plurality (four in the embodiment illustrated) of combustion gas discharging ports 57**.

This arrangement permits flames to flow equally throughout the entire width of the strip 1, both on the inside and outside of the strip loop 6, thereby heating all parts of the strip 1 unfiromly. This allows applying an optimum heating cycle, depending upon the variation in the annealing temperature according to the quality of strip steel, variation in the heating time according to the changes in the conveyor line speed, and so on.

Figure 6:
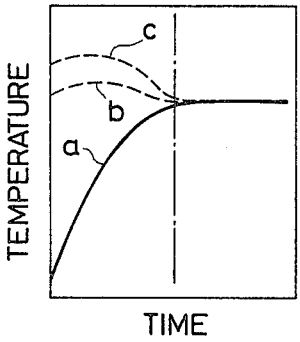
FIG. 6 is a graph schematically showing the relationships among the temperatures of the strip, heating zone and soaking zones in the furnace.

FIG. 6 is a graph showing the relationship between the temperature of strip and the time elapsed after its charging in the furnace. With a heating cycle a, the temperature difference b between the heating zone **16*a* and soaking zone 16*b* is small, with the stream of combustion gas making little temperature interference, when the line speed is low. Therefore, sending the combustion gas around the lower end of the partition 47 to assist the soaking operation in the soaking zone 16*b*** is advantageous from the standpoint of energy saving and annealing temperature control.

Even with the same heating cycle, however, there arises a large temperature difference c between the heating zone **16*a* and soaking zone 16*b* as the line speed increases. If the high-temperature combustion gas in the heating zone 16*a* is sent to the soaking zone 16*b*, the temperature in the lower section of the soaking zone 16*b* becomes too high, even if no fuel is burned in the soaking zone 16*b*, to attain the desired annealing temperature. In such cases, the desired end is achieved by passing the combustion gas from the soaking zone 16*b* to the heating zone 16*a*. This is the reason why the combustion gas exhaust ports 57 are provided not only in the upper part of the soaking zone 16***b* but also in the upper part of the heating zone 16*a*.

If the combustion gas exhaust ports 57 are provided only on one side of the furnace, like the port 57*a* in FIG. 5, the stream of flames in the furnace would become unbalanced, failing to give uniform heating across the width of the strip 1. Therefore, at least one exhaust port is provided on each side of the furnace.

To heat all parts of the furnace to the same desired temperature, a damper 58 is provided to each of the combustion gas exhaust ports 57 so that the flow of flames inside the furnace can be adjusted by opening and closing the damper 58.

The following paragraphs describe the condition of the furnace while the annealing line is stopped or shut down.

Because of the need to quickly heat the strip 1 to a high temperature, the heating chamber 16 is filled with an oxidizing atmosphere at high temperature. If the strip 1 stops running in such an atmosphere, it will immediately become extremely hot and oxidized and, consequently, have to be cropped off. The principal feature of this invention lies in that the vertical continuous annealing furnace according to it is capable of avoiding such difficulty. According to this invention, the bogie 43 carries the second furnace cover 41 outside the path line, bringing the partition 47 into the receding chamber 17 shown in FIGS. 2 and 3 while allowing the strip 1 to stay in its original position. When the second furnace cover 41 has fully receded to allow the heating chamber 16 to communicate with the pre-chamber 15 to form a single hollow space, the deflector pinch rolls 71 or 72 are actuated to raise the lower end 4 of the strip loop to a point indicated by a broken line in FIG. 1. Then, the bogie 43 carrying the second furnace cover 41 is returned onto the path line to bring the partition 47 out of the receding chamber 17 back to its original position. By doing this operation quickly, the lower end 7 of the strip loop 6 can be raised from the heating chamber 16 to the pre-chamber 16 in an extremely short time. The clearances between the first furnace cover 21, front and rear walls 18 and second furnace cover 41 are sealed at three levels by means of the water-seal grooves 28, 48 and 51, etc. Therefore, the atmosphere of the heating chamber 16 does not flow into the pre-chamber 15. With the heat radiated from the walls of the heating chamber 16 cut off by the second furnace cover 41, the strip loop in the pre-chamber 15 is protected from the oxidization and heating by the oxidizing atmosphere and radiant heat in the heating chamber 16. All this contributes to the principal advantage of this invention that the strip 1 remains undamaged even when the annealing line is stopped or shut down.

When a great deal of strip 1 has been annealed, the strip loop 6 can be discharged out of the heating chamber 16 by reversing the above-described procedure.

Other Embodiments of the Furnace

Some other structures of the furnace will be described in the following by reference to respective drawings, in which similar parts are designated by the same reference numerals that are used in FIG. 1. For the purpose of simplicity, the pre-chamber and its associated systems are omitted in FIGS. 10, 11, 15, 17 and 18.

In an annealing furnace of the type illustrated in FIG. 1, the furnace proper 11 is divided by the partition 47 into the heating zone 16*a* and the soaking zone 16*b*. In the pre-chamber 15, radiative heat transfer takes place between the low-temperature strip just charged and the high-temperature strip that is about to be discharged, cooling the strip on the discharging side to unnecessarily low temperatures. In an embodiment that follows, the first furnace cover is provided with a vertically hanging partition to separate the pre-chamber into two zones to minimize the heat exchange between the incoming and outgoing strip.

Figure 7:
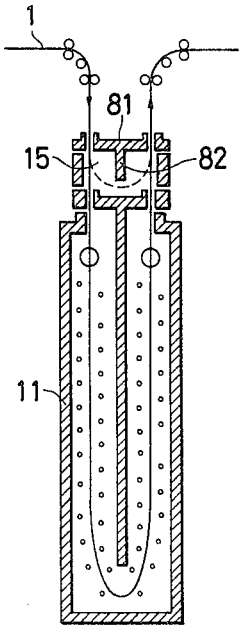
FIG. 7 is a vertical cross section showing another embodiment of this invention.

As shown in FIG. 7, a pre-chamber partition 82 hangs down from substantially the center of the first furnace cover 81 mounted on the top of the pre-chamber 15. When the furnace proper 11 fails or other necessity arises, the strip is raised out of the heating and soaking chambers to a position indicated by a broken line in the figure. The pre-chamber partition 82 has the greatest length allowable within the range that it does not interfere with the strip in the aforementioned raised position.

Because of this structure, this embodiment is particularly useful in applications in which strip of stainless or other special steel is annealed at a temperature of 800° C. to 1,000° C. and then quenched from a temperature of 750° C. to 800° C. With the vertical continuous annealing furnace, the cooling zone is usually provided where the strip coming out of the furnace travels horizontally. Placing the cooling zone above the furnace could create various troubles such as the leakage of cooling water. If the aforesaid radiative heat transfer takes place between the incoming and outgoing strip in the pre-chamber 15 shown in FIG. 7, the temperature of the outgoing strip becomes too low to maintain the temperature at which quenching is scheduled to start. Dividing the pre-chamber 15 by the pre-chamber partition 82 prevents such undesirable temperature drop and, thereby assures the attainment of the desired quality.

Dividing the pre-chamber 15 also permits utilizing the pre-chamber 15 as part of the soaking zone, which, in turn, enables reducing the height of the entire furnace.

With the vertical continuous annealing furnaces described so far, the furnace cover or covers must be changed from time to time, depending upon the kind of application or whether the intended annealing operation does not needs, or need the partition. Or otherwise, even such annealing as essentially can dispense with the partition is forced to be implemented with the partition in position, with a resulting worsening in unit heat consumption. Another embodiment described below comes with a furnace cover provided with a long narrow opening that can be moved in and out of the path line and a guide device to bring a hanging partition to below the furnace cover. The partition, adapted to be reciprocated by the guide device, is brought to the center of the path line when the intended annealing operation requires it, and taken outside the path line when it is unnecessary.

Figure 8:
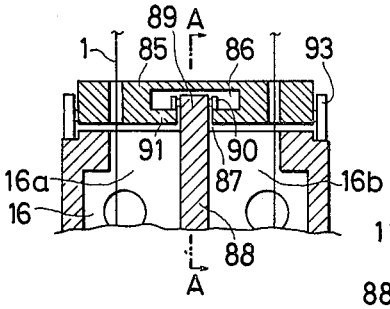
FIG. 8 is a vertical cross section showing another example of the furnace cover.
Figure 9:
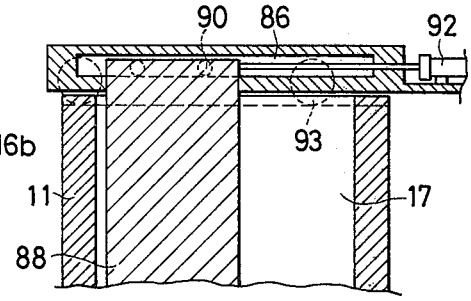
FIG. 9 is a cross-sectional view taken along the line A—A in FIG. 8.

As shown in FIGS. 8 and 9, the second furnace cover 85 has a horizontal chamber 86 at the center thereof and a slit-like opening 87 that connects the chamber 86 to the heating chamber 16.

The top 89 of the partition 88, which divides the heating chamber 16 into the heating zone 16*a* and soaking zone 16*b*, is admitted in the chamber 86 through the opening 87. By means of guide rollers 90 attached to both sides of the top 89, the partition 88 is hung from the projections 91 in the furnace cover 85 in a laterally movable manner. To the rear end of the partition 88 is connected a hydraulic cylinder 92 fastened on the furnace cover 85. Driven by the hydraulic cylinder 92 and guided by the projections 91, the partition 85 moves back and forth, receding, as required, into the receding chamber 17 provided on one side of the furnace proper 11.

When the intended annealing calls for thermally separating the entry side from the exit side, the partition 88 is taken out of the chamber 86 in the furnace cover 85 and brought to the center of the path line as shown in FIG. 9, by means of the guide rollers 90 and drive cylinder 92. When no such need exists, the partition 88 is moved to the right in FIG. 9 until it retreats into the receding chamber 17.

When there arises the need to stop annealing and empty the furnace, the furnace top can be easily opened by moving the furnace cover 85 and partition 88 jointly from the central position shown in FIG. 9 to the receding position by use of transfer rollers 93 and a drive unit not shown.

The furnace structure just described assures compactness, good workability, and highly efficient annealing.

Figure 10:
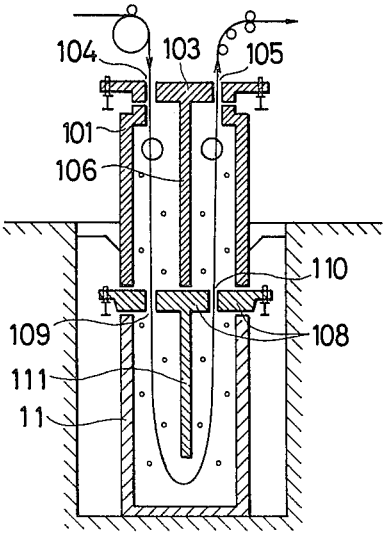
FIG. 10 is a vertical cross section showing still another embodiment of this invention.

An embodiment shown in FIG. 10 has a plurality of furnace covers so that the length of the furnace walls is variable as required. This emobdiment permits controlling the temperature of the strip being annealed, thereby allowing effective utilization of heat energy and establishing the desired heating pattern.

As shown, the furnace mouth 101 is covered with a first furnace cover 103. A second furnace cover 108 divides the furnace proper 11 into the upper and lower sections at a level substantially equal to one-half the height of the furnace proper 11. Like those described heretofore, the furnace covers 103 and 108 are provided with long narrow openings 104, 105, 109 and 110, and partitions 106 and 111, and are laterally reciprocatable.

With this arrangement, this embodiment can offer various heating cycles and service conditions according to the kind of strip and production capacity required.

When a plurality of vertical continous annealing furnaces, disposed in series, are used for carrying out annealing with a heating cycle in which heating time is equal to soaking time, the furnace in front can be used as a heating zone and the furnace at the rear as a soaking zone. In this case, the furnace functioning as the heating zone needs a partition to cut off the thermal influence between the incoming and outgoing strip. Serving as the soaking zone, meanwhile, the rear furnace needs only short partitions 106 and 111 or no partitions at all. In the latter case, the second furnace cover 108 and the integral partition 111, shown in FIG. 10, are moved out of the path line to provide an undivided space within the furnace.

When it is desired to lower the production rate and make the soaking time considerably longer than the heating time, the partition in the front furnace is shortened, with the partition of the rear furnace withdrawn in the receding chamber (not shown).

Evidently, this embodiment offers a great advantage allowing various types of annealing under different conditions. FIG. 10 shows an embodiment with two furnace covers, and still greater advantage can be derived if more furnace covers are provided.

FIGS. 11 through 14 show different structures of the furnace wall. Since the furnace is hollow and no pressure is applied thereon by the strip charged, the furnace wall is not required to have strength to withstand any great pressure. On the other hand, the furnace wall should hold as little heat as possible to permit quick changes of heating pattern according to the type of steel treated. The furnace wall refractories should therefore preferably have a high thermal resistance and a high heat-insulating property. Ceramic fiber is a good example. Yet, furnace walls of fragile ceramic fiber can be damaged by a strip that falls upon breaking or strikes the furnace walls while traveling in the form of a free loop. So the furnace walls must be protected against such damage.

Figure 11:
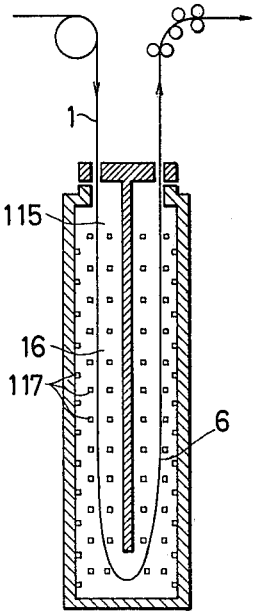
FIG. 11 is a vertical cross section of the furnace proper to illustrate the structure of the furnace walls.
Figure 12:
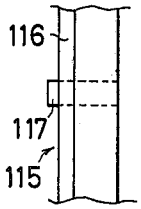
FIG. 12 is a partial cross section of a furnace wall.

In an embodiment shown in FIGS. 11 and 12, the furnace walls 115 are lined with ceramic fiber 116, with a number of small square pillar-like refractory bricks 117 implanted in the ceramic fiber-lined walls so as to protrude from the fiber lining. These refractory bricks 117 are spalling-proof.

Figure 13:
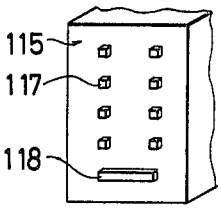
FIGS. 13 and 14 are partial perspective views showing different furnace wall structures.
Figure 14:
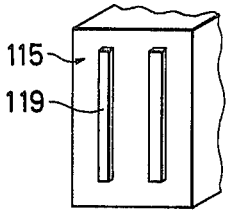

FIG. 13 shows an embodiment in which the square-pillar-like refractory bricks 117 are mixed with a horizontal plate-like refractory brick 118. FIG. 14 shows an embodiment in which only vertical plate-like refractory bricks 119 are used.

The cross-sectional area per piece and the number of the spalling-proof refractory bricks 117, 118 and 119 implanted on the furnace walls 115 must be held to a minimum within the reasonable limit. This is because the heat-insulating property of the spalling-proof refractory bricks 117, 118 and 119 is lower than that of the ceramic fiber 116. The greater, therefore, the area occupied by the spalling-proof refractory bricks, the greater will be the heat loss. On the other hand, if the number of bricks is reduced excessively to leave overmuch spaces therebetween, it becomes no longer possible to prevent the contact of the weaving strip 1 with the ceramic fiber 116. Preferably, therefore, each furnace wall 115 should have two vertical rows of bricks, each row comprising ten-odd bricks. Even if the bricks are arranged in a horizontally or vertically close-packed row, one next to another, the smae effect can be achieved as when they are separated from each other.

With this arrangement, the free loop 6 of the strip 1 is at all times kept out of contact with the fragile ceramic fiber 116 even when it comes in contact with the furnace walls 115 on being pushed by the stream of flames in the heating chamber 16 or as a result of changes in the path line caused by the thermal deformation of the strip itself, the weaving of the free loop 6 owing to various causes, and so on. Supported by the square pillar-like refractory bricks 117, horizontal plate-like refractory bricks 118 or vertical plate-like refractory bricks 119, the free loop 6 of the strip 1 does nothing more than run over the surface of such bricks, without deforming or damaging the ceramic fiber 116. The reason why the bricks with particularly high spalling-proofness are chosen is that the projected part of the refractory bricks 117, 118 and 119 and have experimentally proved to be vulnerable to thermal spalling.

Cooling Control on Exit Side

The strip coming out of the annealing furnace retains an extremely high temperature. Stainless and other special steels must attain, after cooling, more delicate metal structures than plain carbon steel. All this demands that special consideration must be given to their cooling means.

A device described below permits applying cooling according, as required, to the type of steel, thickness of strip, and the kind of metal structure desired and by detecting the temperature of the outside atmosphere, the temperature and travel speed of the strip, on the exit side of a vertical continuous annealing furnace. This cooling device, provided on the exit side of the continuous annealing furnace, predicts the temperature and cooling rate in each section of the strip, and then controls the operation, or, more specifically, the zone and quantity of water spray where water is used as the cooling medium, in the following cooling zone.

Figure 15:
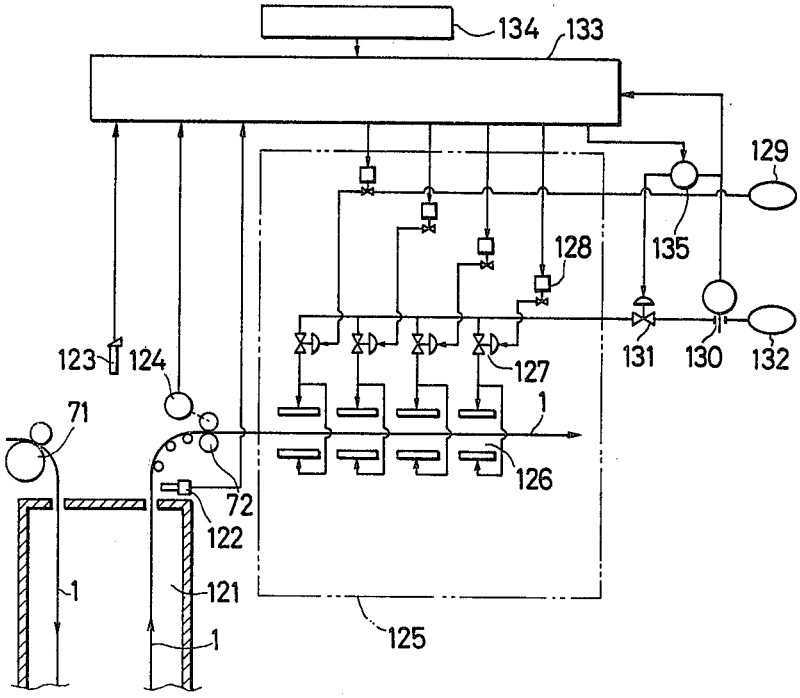
FIG. 15 is a system diagram showing an example of a cooling device provided on the delivery side of the vertical continuous annealing furnace.

As shown in FIG. 15, a radiation pyrometer 122 to measure the surface temperature of the strip 1 is provided on the exit side of a vertical continuous annealing furnace 121. A thermometer 123 to measure the temperature of the outside atmosphere is provided above the furnace 121. A line-speed detector 124 follows the exit-side deflector pinch rolls 72.

A cooling device 125, which follows the line-speed detector 124, is equipped with cooling water sprays 126 disposed in four stages along the path line. Each stage consists of paired sprays 126, one placed above the other, to apply cooling water from above and below the strip 1.

Each cooling water spray 126 is coupled to an on-off valve 127, and to the operating part of each valve 127 is supplied compressed air from an air source 129 through a solenoid valve 128. Each on-off valve 127 is connected to a pressurized cooling water supply 132 by way of a total flow-rate detector 130 and a total flow-rate regulating valve 131.

To an arithmetic unit 133 that determines the operating section in the cooling zone and controls the total flow rate of cooling water is connected the radiation pyrometer 122, outside atmosphere thermometer 123, line-speed detector 124, and total flow-rate rate detector 130. To this arithmetic control unit 133 is also connected a device 134 that sets the type of steel, thickness of strip, and kind of metal structure desired.

The solenoid valve 128 is actuated by the signals sent from the arithmetic control unit 133. The signals from the arithmetic control unit 133 are also inputted into the total flow-rate regulating valve 131 through a controller 135. The signals from the total flow-rate detector 130 are fed back to the controller 135.

Now the operation of this device will be described.

The radiation pyrometer 122 measures the exact temperature of the strip 1 coming out of the annealing furnace 121 and supplies the obtained temperature information to the arithmetic control unit 133. At the same time, the line-speed detector 124 at the deflector pinch rolls 72 detects the travel speed of the strip 1 and supplies the obtained line-speed information to the arithmetic control unit 133. Also, the temperature of the atmosphere around the exit end of the annealing furnace is measured by the outside atmosphere thermometer 123 and inputted to the arithmetic control unit 133.

Based on the information thus supplied, the arithmetic control unit 133 controls the cooling device 125. More specifically, the arithmetic control unit 133 determines the number and section of the cooling water sprays 126 that must be put into operation as well as the quantities of water to be sprayed in each section and the whole cooling zone.

Based on the result of this arithmetic calculation, the on-off valve 127 and solenoid valve 128 connected to each cooling water spray 126 are actuated. The total flow-rate detector 130 grasps the flow rate that changes from moment to moment. If there arises any discrepancy between the flow rate thus measured and the result of calculation made by the control unit 133, a correction signal is sent through the total flow-rate controller 135 to the total flow-rate regulating valve 131 to control the actual flow rate.

The type of steel, thickness of strip, kind of metal structure desired and other data are input, as required, to the data setter 134. Combined with the travel speed and temperature of the strip coming out of the annealing furnace 121 and the temperature of the outside atmosphere, these data are used for the calculation of the optimum cooling condition according to which the cooling section and water flow-rate are controlled to achieve the most efficient cooling.

Figure 16:
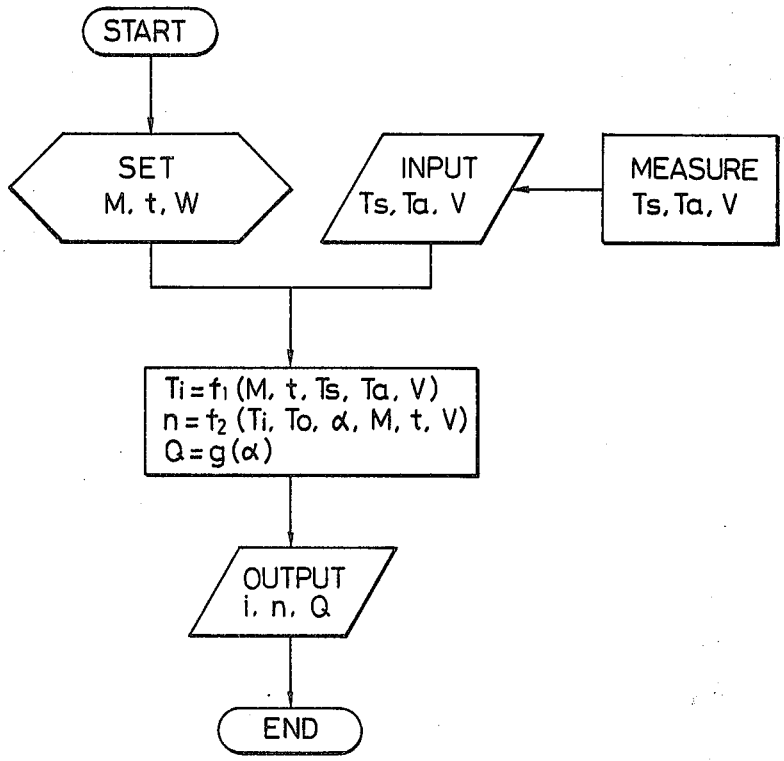
FIG. 16 is a flow chart showing the process of operation in the control unit of the cooling device illustrated in FIG. 15.

FIG. 16 is a flow chart showing the process of arithmetic calculation performed by the arithmetic control unit 133. By using the preset values M (type of steel) and t (thickness of strip) and the measured values Ts (temperature of strip), Ta (temperature of outside atmosphere) and V (line speed), the control unit 133 determines, from equation Ti, the temperature of strip at the entrance of each section of the cooling zone, and then the cooling starting section i that satisfies the temperature range is preset as the starting point of cooling. Next, the number of cooling sections put in operation n is determined in order to satisfy the preset range of necessary cooling rate W as well as to keep the strip temperature at the exit end of the cooling zone To below the level of the heat resistivity of the subsequent equipment. Then, the heat transfer rate $\alpha$ between the strip and cooling water and the total quantity of spray water Q are determined.

Multi-series Type Vertical Continuous Annealing Furnace

Because of the limited treating capacity, it is difficult to apply a variety of heating patterns required by different kinds of strip with one vertical continuous annealing furnace.

However, this problem can be solved by passing the strip through a plurality of vertical continuous annealing furnaces arranged in series. More effective annealing can be attained by making the mid-furnace partition shorter in the downstream furnace than in the upstream furnace.

Figure 17:
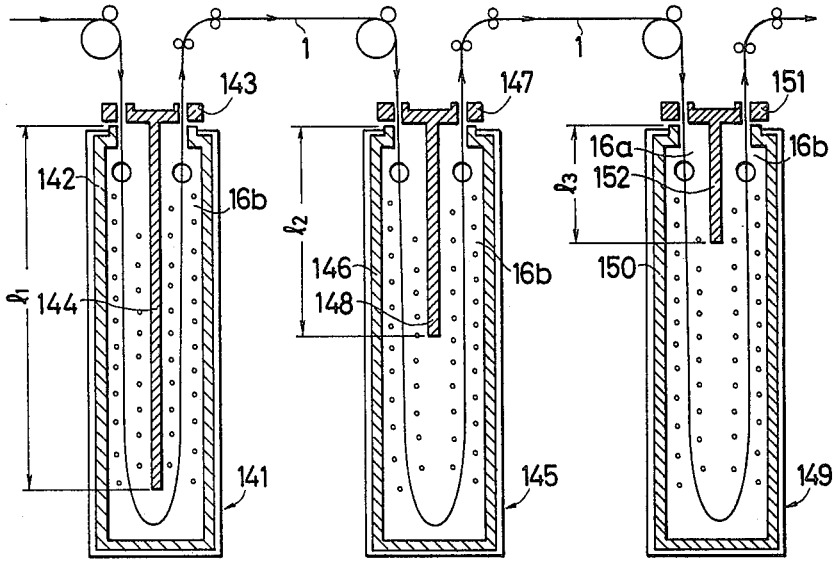
FIG. 17 is a cross-sectional view showing a plurality of vertical continuous annealing furnaces disposed in series.

FIG. 17 shows an example of such a multi-series type vertical continuous annealing furnace. The furnaces 141, 145 and 149, disposed in series at suitable intervals, are respectively covered with furnace covers 143, 147 and 151 having vertical partitions 144, 148 and 152. The structures of the furnace propers 142, 146 and 150 and the furnaces covers 143, 147 and 151 are basically the same as those described before. The furnace covers 143, 147 and 151 are laterally slidable. With the three vertical continuous annealing furnaces 141, 145 and 149 placed adjacent to each other as shown, any desired heating pattern can be attained by passing the strip 1 coming out of the furnace 141 through the heating and soaking zones of the furnace 145, and then through the furnace 149.

The example shown in FIG. 17 uses three vertical continuous annealing furnaces disposed in series, but a similar effect can be achieved with any combination involving two or more furnaces.

Further, a wider variety of heating patterns can be applied to the strip by making the length $l_2$ of the partition 148 in the furnace 145 shorter than the length $l_1$ of the partition 144 in the preceding furnace 141, and, similarly, the length $l_3$ of the partition 152 in the last furnace 149 shorter than the length $l_2$.

This invention is not limited to the embodiment illustrated but is applicable to all combinations containing two or more vertical continuous annealing furnaces, with the relationships among the partition lengths maintained as $l_1 > l_2 > l_3 \ldots$. This invention holds good as well when, for example, $l_2$ and $l_3$ are zero, that is, when no mid-furnace partition is provided With this arrangement, the furnaces 141 and 145 may be employed solely for heating and the furnace 149 solely for soaking. This permits greatly increasing the speed of strip travel and, therefore, the rate of production. In this case, the respective soaking zones **16*b* of the furnaces 141 and 145 serve as the second heating zone, whereas the heating zone 16*a* and the soaking zone 16*b* of the furnace 149** serve as the first and second soaking zones, respectively.

With a heating cycle in which heating time equals soaking time, adequate heating cannot be accomplished if the formost furnace had no mid-furnace partition since heat transfer would take place between the strip just charged at ordinary temperature and the outgoing strip at high temperature. In this case, the partition is essential to keep the high-temperature strip away from the low-temperature strip. In the downstream furnaces used mainly for soaking, the incoming strip differs little in temperature from the outgoing strip as a result of heating in the preceding furnace. So the partition, which is indispensable in the foremost furnace, need not be provided in the subsequent furnaces.

Where soaking time is shorter than heating time, an adequately long partition must be provided in the upstream furnace, whereas the partition in the downstream furnace need not be so long; any length adequate for heating will suffice.

Thus, this invention enables the most effective utilization of heat energy with any desired heating pattern. The furnaces with shorter or no partitions offer many commercial advantages, such as the saving in capital investment and enhancement of maintainability.

With the multi-series vertical continuous annealing furnace described above, the strip in transit from one furnace to another is cooled by the outside air, creating such problems that heat energy is lost, the desired strip temperature is not obtained, and so on. To solve these problems, an embodiment described in the following has a refractory-lined holding cover to enclose the exposed path line of the strip between adjacent furnaces. This holding cover can be moved in and out of the path line and, at the same time, can be partially opened and closed as required.

Figure 18:
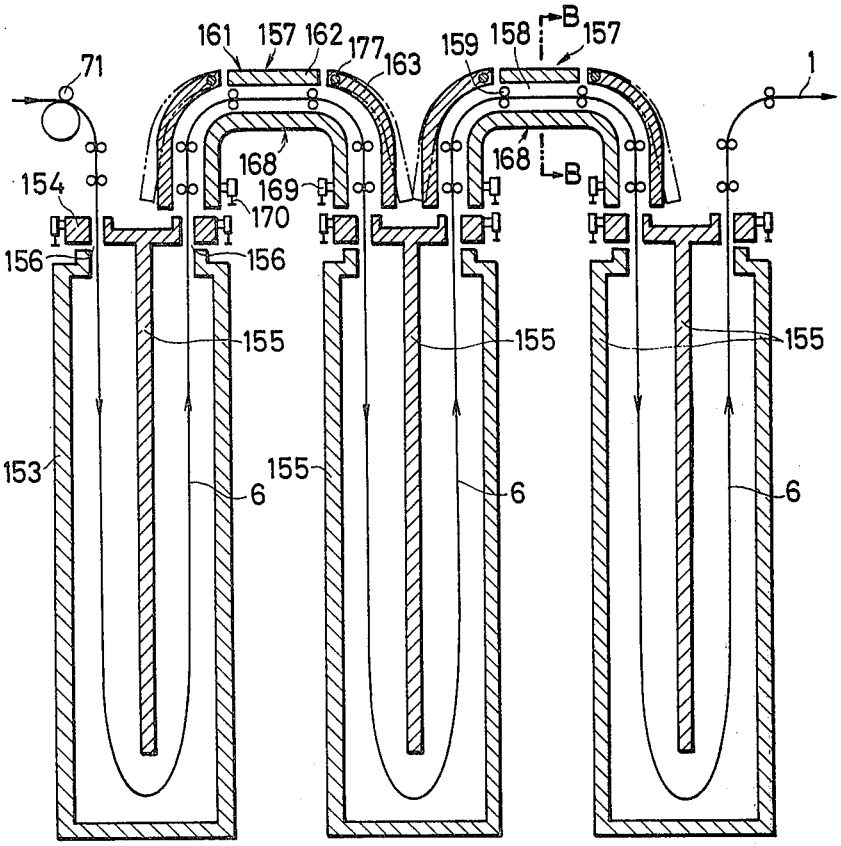
FIG. 18 is a cross-sectional view showing an example of a holding cover connecting two adjacent vertical continuous annealing furnaces disposed in series.

Each of the three furnaces 153 shown in FIG. 18 is connected to an adjacent one by means of a holding cover 157 shaped like the letter U in cross section. The structure of each furnace 153 is basically the same as that described before. The holding cover 157 contains a U-shaped strip passage 158 along which paired guide rollers 159 are provided to support the strip 1 from both sides.

The external wall 161 of the holding cover 157 is made up of a horizontal member 162 and preceding and following curved members 163. The internal wall 168 of the holding cover 157 is U-shaped in cross section. Shaped like a groove as shown in FIG. 19, the external wall 161 and internal wall 168 together make up the strip passage 158 that is rectangular in cross section.

Figure 19:
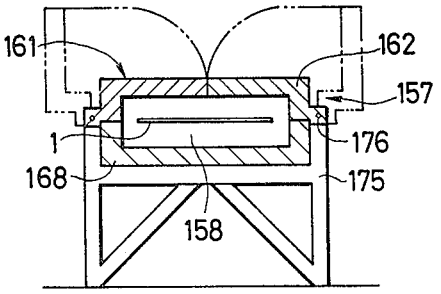
FIG. 19 is a cross section taken along the line B—B of FIG. 18.

The horizontal member 162 of the external wall 161 is divided into two symmetrical parts that are each hinged to a frame 175 with a pin 176, as shown in FIG. 19. The top of the curved member 163 is also hinged, as shown in FIG. 18, to the frame 175 shown in FIG. 19 with a pin 177. The horizontal member 162 is opened and closed sideways and the curved member 163 longitudinally by means of a cylinder or other drive unit (not shown).

The internal wall 168 is fixed to the frame 175 and carries a wheel 169 in the lower portion of its front and rear ends. The internal wall 168 is mounted via the wheels 169 on rails 170 laterally extending right above the furnace cover 154. This permits the holding cover 157 to be moved out of the path line.

Now that a plurality of vertical continuous annealing furnaces 153 are arranged in series as described above, the strip 1, guided by the guide rollers 71, enters the furnace through the long narrow opening 156 in the furnace cover 154. Forming a free loop 6, the strip 1 is heated and soaked in the zones divided by the vertical partition 155, and discharged through the long narrow opening 156. Guided by the guide rollers 159 in the holding cover 157, the strip 1 travels further into the next vertical continuous annealing furnace 153.

This furnace arrangement permits continuously annealing the strip that has been heated and soaked at high temperatures in the preceding furnace, without bringing it into direct contact with the low-temperature atmosphere when the strip comes out of the furnace through the slit-like discharging port. Accordingly, this prevents the temperature drop and quality deterioration of the strip while assuring the desired temperature control and heat treatment.

When the need arises to inspect and repair the furnace or service the guide rollers, their bearings and the like, easy access to them can be gained by moving the holding cover 157 out of the path line, opening the horizontal member 162 as shown in FIG. 19, and opening the curved members 163 as indicated by a broken line in FIG. 18.

What is claimed is:

1. A vertical continuous annealing furnace, comprising:

a furnace proper having a furnace mouth opening upward in the top thereof, for admitting a steel strip into the furnace, the strip forming a catenary-like loop therein;

a first furnace cover horizontally mounted on the top of the furnace proper so as to close said furnace mouth, the first furnace cover being laterally slidable with respect to the furnace proper so as to open and close the furnace mouth and having two long narrow openings laterally extending from one side to the other thereof and longitudinally spaced so that the descending and ascending portions of the strip can pass therethrough; and a second furnace cover horizontally spaced below said first furnace cover so as to divide the furnace proper into an upper pre-chamber and a lower heating chamber, the second furnace cover being laterally slidable so as to permit the two chambers to be cut off and connected as required, having two long narrow openings laterally extending from one side to the other thereof and longitudinally spaced so that the descending and ascending portions of the strip can pass therethrough, the second furnace cover also having a partition extending from the undersurface thereof to near the bottom of the furnace to vertically divide the heating chamber into a heating zone and a soaking zone.

2. A vertical continuous annealing furnace according to claim 1, wherein the furnace proper includes side walls enclosing the heating chamber, the annealing furnace further comprising plurality of heating burners located on the side walls of the heating chamber that face the edges of the strip admitted therein, the heating burners being disposed at substantially equal distance from both surfaces of the strip and spaced vertically from each other, with the burners on one side of the strip being held aslant with respect to those on the other side.

3. A vertical continuous annealing furnace according to claim 1, further comprising a combustion gas exhaust port near the top of each side wall of the heating and soaking zones in the heating chamber.

4. A vertical continuous annealing furnace according to claim 1, in which the first furnace cover has a vertically hanging partition to divide the pre-chamber into an upstream and a downstream chamber.

5. A vertical continuous annealing furnace according to claim 1, in which the partition of the second furnace cover is laterally slidable with respect to the undersurface thereof.

6. A vertical continuous annealing furnace according to claim 1, further comprising a plurality of second furnace covers in the furnace proper for dividing the heating chamber into a plurality of horizontal sections.

7. A vertical continuous annealing furnace according to claim 1, in which the walls of the furnace proper include a ceramic fiber lining and randomly implanted inwardly projecting spalling-proof refractory bricks.

8. A vertical continuous annealing furnace according to claim 1, further comprising a sealing means mounted on the first furnace cover, the sealing means having a closable slit-like opening located right above said long narrow opening to allow the passage of the strip.

9. A vertical continuous annealing furnace according to claim 1, which comprises:

first means for detecting and for providing a first signal indicating the temperature of the atmosphere outside the furnace, said first detecting means being disposed near the end of the furnace where the strip exits through the furnace mouth;

seconds means for detecting and for providing a second signal indicating the temperature of the strip, said second detecting means being disposed on the side of the furnace where the strip exits through the furnace mouth;

third means for detecting and for providing a third signal indicating the travel speed of the strip, said third detecting means being disposed on the side of the furnace where the strip exits through the furnace mouth;

means for spraying cooling water on the strip, said spraying means comprising a plurality of cooling sections disposed along the longitudinal direction of the strip; for spraying cooling water along segments of the strip; and means responsive to the first, second and third signals, for selecting a cooling section that is put into operation to cool the strip to the desired temperature and controlling the quantity of water sprayed by the selected cooling section.

10. A vertical continuous annealing furnace comprising a plurality of unit furnaces arranged in series, each unit furnace comprising:

a furnace proper having a furnace mouth opening upward in the top thereof, for admitting a steel strip into the furnace, the strip forming a catenary-like loop therein;

a first furnace cover horizontally mounted on the top of the furnace proper so as to close said furnace mouth, the first furnace cover being laterally slidable with respect to the furnace proper so as to open and close the furnace mouth and having long narrow inlet and outlet openings laterally extending from one side to the other thereof and longitudinal spaced so that the descending and ascending portions of the strip can pass therethrough; and a second furnace cover horizontally spaced below said first furnace cover so as to divide the furnace proper into an upper pre-chamber and a lower heating chamber, the second furnace cover being laterally slidable so as to permit the two chambers to be cut off and connected as required, having two long narrow openings laterally extending from one side to the other thereof and longitudinally spaced so that the descending and ascending portions of the strip can pass therethrough; the second furnace cover including a partition extending from the undersurface thereof to near the bottom of the furnace to vertically divide the heating chamber into a heating zone and a soaking zone.

11. A vertical continuous annealing furnace according to claim 10, in which the partition in each downstream furnace is shorter than the one in the preceding furnace.

12. A vertical continuous annealing furnace according to claim 10, further comprising a holding cover to enclose the strip, the holding cover connecting the outlet opening of one furnace and the inlet opening of the adjacent downstream furnace and being laterally slidable so as to open the outlet opening and inlet opening of the connected furnaces.

13. A method of operating a vertical continuous annealing furnace that heats and anneals a strip of steel charged and discharged through slit-like charging and discharging ports in the top and forming a free loop inside the furnace, comprising:

providing a plurality of vertically spaced detecting means near the lower end of the strip loop in the heating chamber, each detecting means comprising a light emitter and a light receiver, and automatically regulating the travel speed of the strip according to the signals sent from said ditecting means so that the lower end of the strip loop is held between the upper set of light emitter and receiver and the lower set of light emitter and receiver.

14. A method of operating a vertical continuous annealing furnace, having a first furnace cover laterally slidable to open and close the furnace mouth in the top of the furnace proper and a second furnace cover spaced below the first furnace cover to divide the furnace proper into an upper pre-chamber and a lower heating chamber, the second furnace cover being laterally slidable and having a vertically hanging partition to divide the heating chamber into an upstream and a downstream zone, which heats and anneals a strip of steel charged and discharged through slit-like charging and discharging ports in the top and forming a free loop inside the furnace, comprising:

providing detecting means on the side walls of said pre-chamber, the detecting means comprising a light emitter and a light receiver;

lowering the strip after moving the first furnace cover out of the path line, with the heating chamber closed with the second furnace cover;

charging the strip in the heating chamber after confirming that the lower end of the strip loop exists within the pre-chamber by use of said detecting means and returning the first furnace cover onto the path line; and discharging the strip outside the furnace by reversing said steps.

15. A method of operating a vertical continuous annealing furnace that heats and anneals a strip of steel charged and discharged through slit-like charging and discharging ports in the top and forming a free loop inside the furnace, comprising:

providing a combustion gas exhaust port on each side of the strip in the heating and soaking zones separated by the partition hanging from the furnace cover; and controlling the flow of the combustion gas according to the heating cycle being applied by means of a damper provided at the exit end of said exhaust port.

* * * * *